US011614284B2

(12) United States Patent
Kornilov et al.

(10) Patent No.: US 11,614,284 B2
(45) Date of Patent: Mar. 28, 2023

(54) HEAT EXCHANGER COMPRISING A STACK OF CELLS

(71) Applicant: Micro Turbine Technology B.V., Eindhoven (NL)

(72) Inventors: Viktor Kornilov, Geldrop (NL); Paulus Maria Smeets, Tilburg (NL); Luuk Verbakel, Eindhoven (NL)

(73) Assignee: Micro Turbine Technology B.V., Eindhoven (NL)

( * ) Notice: Subject to any disclaimer, the term of this patent is extended or adjusted under 35 U.S.C. 154(b) by 90 days.

(21) Appl. No.: 16/758,650

(22) PCT Filed: Oct. 23, 2018

(86) PCT No.: PCT/NL2018/050705
§ 371 (c)(1),
(2) Date: Apr. 23, 2020

(87) PCT Pub. No.: WO2019/083361
PCT Pub. Date: May 2, 2019

(65) Prior Publication Data

US 2020/0348083 A1 Nov. 5, 2020

(30) Foreign Application Priority Data

Oct. 24, 2017 (NL) ..... 2019792

(51) Int. Cl.
*F28D 1/03* (2006.01)
*F28F 3/06* (2006.01)
(Continued)

(52) U.S. Cl.
CPC ..... *F28D 1/0308* (2013.01); *F28D 1/0366* (2013.01); *F28F 3/022* (2013.01);
(Continued)

(58) Field of Classification Search
CPC ..... F28D 1/0308; F28D 1/0366; F28F 3/022; F28F 3/06; F28F 3/08; F28F 2009/0297; F28F 2255/02; F28F 2265/26
See application file for complete search history.

(56) References Cited

U.S. PATENT DOCUMENTS 3,217,392 A 11/1965 Roffelsen
3,527,291 A * 9/1970 Neary ..... F24H 9/0052 165/83

(Continued)

FOREIGN PATENT DOCUMENTS

EP 0082051 A2 6/1983
WO 2006072789 A1 7/2006
WO 2009108238 A2 9/2009

OTHER PUBLICATIONS

Dutch Search Report issued in application No. NL 2019792 dated Jun. 21, 2018.

(Continued)

*Primary Examiner* — Eric S Ruppert
*Assistant Examiner* — Hans R Weiland
(74) *Attorney, Agent, or Firm* — Troutman Pepper Hamilton Sanders LLP; Ryan A. Schneider; Brandon M. Reed

(57) ABSTRACT

A heat exchanger suitable to be used as a recuperator in a micro gas turbine including a stack of cells. Each of the cells includes a pair of mutually spaced-apart plates and layers including heat exchange elements arranged at the outer surfaces of the plates and between the plates. Each of the layers including heat exchange elements can include at least one discrete spatial component incorporating a number of elements. Both a supply header and a discharge header of the heat exchanger can be made of only two components at the position of the stack of cells. Compensating for heat expan- (Continued)

Figure 1:
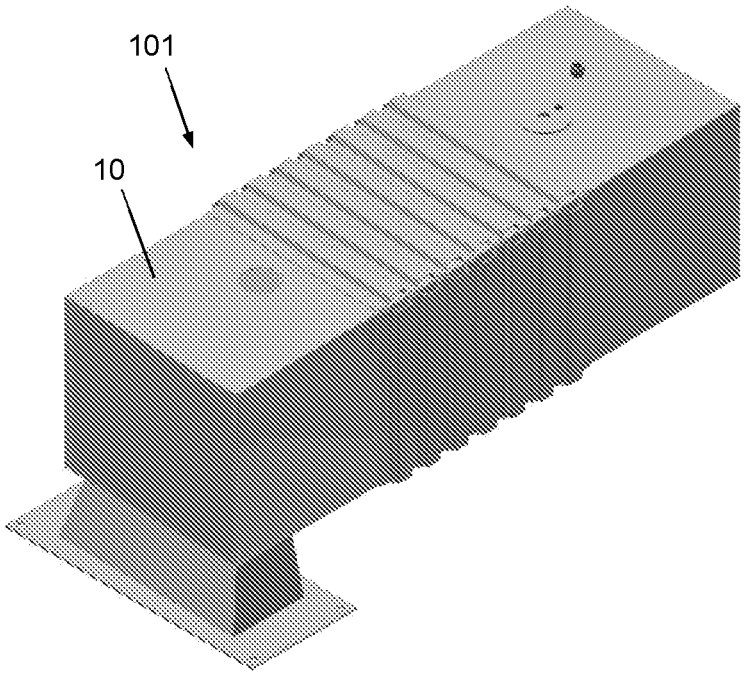

sion effects can be via a bellows-shaped pipe portion of a supply conduit.

20 Claims, 4 Drawing Sheets

(51) Int. Cl.
*F28F 3/02* (2006.01)
*F28F 3/08* (2006.01)

(52) U.S. Cl.
CPC ..... *F28F 3/06* (2013.01); *F28F 3/08* (2013.01); *F28F 2255/02* (2013.01); *F28F 2265/26* (2013.01)

(56) References Cited

U.S. PATENT DOCUMENTS 4,310,960 A * 1/1982 Parker ..... F28F 3/027 165/166
5,695,007 A * 12/1997 Fauconnier ..... F28D 9/0006 165/128
7,036,562 B2 * 5/2006 Ayres ..... F28F 9/0075 165/81
2003/0075308 A1 * 4/2003 Abiko ..... F28D 9/0068 165/148
2004/0065073 A1 * 4/2004 Nash ..... F28D 9/0043 60/39.511
2007/0251671 A1 * 11/2007 Barnes ..... F28F 3/08 165/83
2012/0151934 A1 6/2012 Borissov et al.
2012/0216544 A1 * 8/2012 Eleftheriou ..... F28D 9/0018 60/772
2014/0090824 A1 * 4/2014 Hirsch ..... F28F 3/022 165/170
2015/0144309 A1 5/2015 Nash
2016/0053638 A1 * 2/2016 Stapp ..... F28F 3/08 60/650
2016/0178287 A1 * 6/2016 Karlen ..... F28F 3/022 165/181
2017/0089647 A1 * 3/2017 Schnabel ..... F28F 3/022

OTHER PUBLICATIONS

International Search Report and Written Opinion issued in application No. PCT/NL2018/050705 dated Mar. 4, 2019.

* cited by examiner

HEAT EXCHANGER COMPRISING A STACK OF CELLS

In the first place, the invention relates to a cell for use in a heat exchanger, including a pair of mutually spaced-apart plates which is configured and arranged to define an internal fluid flow path of the cell, particularly between two inner surfaces of the plates facing each other, and an external fluid flow path of the cell, particularly at two outer surfaces of the plates facing away from each other, wherein the plates are connected to each other along the periphery thereof, except at positions where at least one inlet to and at least one outlet from the internal fluid flow path are located, and wherein a plurality of heat exchange elements is arranged in each of the fluid flow paths.

In the second place, the invention relates to a heat exchanger comprising a stack of cells as mentioned and a housing enclosing the stack of cells.

In the third place, the invention relates to a micro gas turbine comprising a compressor, a turbine, a combustor, and a heat exchanger as mentioned, the compressor being designed to take in and pressurize gas, the combustor being designed to take in pressurized gas from the compressor and to generate hot gas on the basis of fuel combustion, the turbine being designed to take in and expand hot gas generated by the combustor, and the heat exchanger being configured and arranged to pre-heat pressurized gas before being supplied to the combustor by allowing the pressurized gas to exchange heat with expanded gas obtained from the turbine.

The invention is especially applicable to the field of gas turbines, particularly micro gas turbines The micro gas turbine may be dimensioned to generate up to 30 kW electric power, or up to 100 kW electric power, for example. A possible application of micro gas turbines is an application for Combined Heat & Power (CHP), which does not alter the fact that other applications are feasible as well. Micro gas turbines and/or micro gas turbine based CHP systems may be used instead of conventional boilers in large houses, offices, plants, schools, stores etc., to mention one example, or may be used in hybrid electric vehicles so as to extend the range of such vehicles, to mention another example. In general, micro gas turbines are known for high reliability, low maintenance demand and low noise level, combined with high efficiency, low weight and low emissions.

A micro gas turbine typically comprises a compressor, a turbine and a particular type of heat exchanger called recuperator. During operation of a micro gas turbine, ambient air is injected and pressurized in the compressor. The compressed air is transported to the recuperator, where it is pre-heated. Further, the pre-heated air is supplied to a combustor for adding more heat so as to obtain a hot gas which is at a required temperature level and outputting the hot gas, the heat being generated by fuel combustion. The hot pressurized gas is supplied to the turbine where it expands and thereby provides mechanical power for both the compressor and a generator coupled to the turbine. The mechanical power of the generator is converted to electric power as a first type of output from the micro gas turbine. The expanded gas, which is still at an elevated temperature, is transported from the turbine to the recuperator for pre-heating incoming air compressed by the compressor, as mentioned. Residual heat still present in the gas after having flown through the recuperator is transferred to water in a gas-to-liquid heat exchanger, so that hot water is obtained as a second type of output from the micro gas turbine. As an alternative, ambient air from an air heating system can be heated by using an air handler, in case forced air heating is used in a building, as is often the case in North America.

The recuperator as used in the micro gas turbine is a gas-to-gas heat exchanger. It is a generally known fact that such recuperator is difficult to design and manufacture in view of the fact that the recuperator needs to be capable of operating under demanding circumstances including high temperatures, high temperature gradients, high pressure differentials between pressurized incoming air and exhaust flue gases, and a high rate of start-stops. In order to guarantee optimal operation of a micro gas turbine, effectiveness of a heat exchange process as facilitated by a recuperator needs to be high, more than 80%, even about 90%. What's more, pressure loss in a recuperator should be kept low, preferably below 5%, as pressure loss involves a reduction of the expansion ratio through the turbine, which is detrimental to the power output. In order to comply with these demanding specifications, an optimal flow distribution within the heat exchanger is required, allowing the maximum available surface area to contribute to the heat exchange.

WO 2006/072789 A1 discloses a heat exchanger which is a recuperator for a gas turbine in one of the possible embodiments thereof. In the heat exchanger, a first header (pipe) is arranged for inflow of a first fluid and a second header (pipe) for outflow of that first fluid, after it has been heated in the heat exchanger. The body of the heat exchanger consists of a stack of mutually spaced-apart substantially rectangular plates arranged between the inflow header and the outflow header of the first fluid with opposite edges respectively facing the headers. The plates are arranged in spaced-apart pairs which are sealed around their edges so as to provide respective sealed units, save only for ducting for inflow and outflow of the first fluid.

The pairs of plates are also mutually spaced apart, providing spacings therebetween which constitute a fluid flow path for a second fluid which thus flows over the outsides of the plate pairs. The inside of the inflow header communicates with the inside of the respective plate pairs by respective flexible curved tubes. Likewise, the inside of the outflow header communicates with the inside of the respective plate pairs by respective flexible curved tubes.

Each pair of plates has arranged thereon a plurality of pins, the pins having a function in enhancing the heat exchange surface. These pins both bridge the spaced-apart plates and extend into the spacings between the plate pairs. During the manufacturing process of the heat exchanger, connections between the plates and the pins are made by means of laser welding, wherein each of the pins is fixed to one of the two plates. In view of the fact that a heat exchanger may comprise hundreds of thousands of pins, this is a very laborious process. Also, making the curved tubes and connecting them between the headers and the plate pairs is an intensive process. The headers are composed of segments which are connected to the respective plate pairs. Consequently, the manufacturing process of the heat exchanger comprises a step of assembling the header by stacking the segments and subjecting them to a connecting action such as welding.

Using a recuperator in a micro gas turbine involves a significant improvement of the efficiency of the micro gas turbine. However, due to its complex design and related laborious manufacturing process, the recuperator is a very expensive component of the micro gas turbine, which determines to a considerable extent the production cost of the micro gas turbine. It is an object of the invention to simplify the design of a heat exchanger which is suitable for use as a recuperator in a micro gas turbine, by simplifying the design of the cells and possibly also other components of the heat exchanger, preferably without introducing disadvantageous effects such as a reduction of efficiency or a reduction of reliability.

In view of the foregoing, the invention provides a cell for use in a heat exchanger, including a pair of mutually spaced-apart plates which is configured and arranged to define an internal fluid flow path of the cell, particularly between two inner surfaces of the plates facing each other, and an external fluid flow path of the cell, particularly at two outer surfaces of the plates facing away from each other, wherein the plates are connected to each other along the periphery thereof, except at positions where at least one inlet to and at least one outlet from the internal fluid flow path are located, and wherein a plurality of heat exchange elements is arranged in each of the fluid flow paths, the cell comprising at least one supply conduit extending from the at least one inlet to the internal fluid flow path, the at least one supply conduit having at least one flexible portion that is compressible and expandable in a direction in which the at least one supply conduit extends.

A notable feature of the cell according to the invention is that the at least one supply conduit of the cell, i.e. a conduit that is arranged for providing access to the internal fluid flow path and that is associated with the inlet to the internal fluid flow path to that end, has at least one flexible portion, particularly at least one flexible portion that is compressible and expandable in a direction in which the at least one supply conduit extends. For example, the at least one flexible portion of the at least one supply conduit may be designed so as to include a bellows-shaped pipe portion. In this way, complex design features such as the flexible curved tubes known from WO 2006/072789 A1 can be omitted while the ability of the design to compensate for heat expansion effects is maintained. It may even be so that it is sufficient to have flexibility at one side of the cell only. In such a case, it is preferred if flexibility is realized at the relatively cold side of the cell, as the choice of possible materials and shapes of components is the largest at that side, whereas at the other side, the choice is restricted due to the higher temperature requirements. Further, the at least one supply conduit may comprise a nozzle pipe portion which diverges in the direction of the at least one inlet to the internal fluid flow path. Such a nozzle pipe portion does not need to be of complex design and may simply be a partially flattened pipe portion, for example.

In a practical embodiment of the cell according to the invention, the plurality of heat exchange elements of a fluid flow path are defined by at least one discrete spatial component incorporating at least a portion of the plurality of heat exchange elements and being at least connected to an adjacent one of the plates. In that way, it is not necessary to rely on providing a plurality of pins or similar elements for increasing the surface area available for heat exchange and optimizing a fluid spreading effect across the plates so as to obtain an equal distribution of the fluid across the plates. Instead, discrete spatial components are used for realizing a plurality of heat exchange elements in the various fluid flow paths. Consequently, in a manufacturing process of a cell for a recuperator, there is no need for laser welding hundreds of thousands of pins which need to be positioned either individually or in groups, and there is no need for specific tooling like casting dies, orbital welding equipment and a customized pin welding machine. Also, there is no need for other tooling like expensive stamps as conventionally used in a process of making recuperators of the type called primary surface recuperators. For the sake of completeness, in conformity with the above explanation of the functionality of the pins of the heat exchanger known from WO 2006/072789 A1, it is noted that the heat exchange elements are elements which are configured to increase the heat exchange surface of the heat exchanger. Advantageously, the heat exchange elements also have a function in spreading fluid across the plates. The fact is that optimizing effectiveness of the heat exchanger is closely related to optimizing the flow distribution. In practical situations, the design of the heat exchange elements is at the same time aimed at minimizing the extent to which the presence of the heat exchange elements contributes to a pressure drop in the heat exchanger.

According to a first feasible example, the cell may comprise at least one discrete spatial component which includes a wire wound to a coil. In that case, it is practical if the cell comprises a plurality of such spatial components and the spatial components are positioned so as to extend alongside each other in a substantially parallel arrangement, at the same time being arranged in such particular way that fluid flows are not blocked and flow distribution is optimized. The windings of the coils have a similar effect on the heat exchange process and the spreading of the fluid to be subjected to the heat exchange process as the conventional pins. The coils may be of a generally flattened design so as to keep a dimension of the cell perpendicular to the plates within acceptable limits. According to a second feasible example, the cell may comprise at least one discrete spatial component which includes a wire mesh. In that case, it is even more simple to cover an area of the cell with heat exchange elements. A wire mesh may be provided in any suitable form, wherein the wire mesh may be folded in any suitable way. Further, a wire mesh may particularly comprise a woven structure of fibers or a non-woven structure of fibers. For example, the wires of a wire mesh may be arranged in a woven structure in the form of an open mattress. Providing a wire mesh, a wire coil or another type of discrete spatial component involves providing a plurality of heat exchange elements in one go or in only one handling step, whereas providing pins involves providing a plurality of heat exchange elements in a one-by-one process. Examples of another type of discrete spatial component include foils, louvres, elongated ribs of any suitable shape, metal foam, etc.

It may be so that when at least one discrete spatial component is used in the internal fluid flow path as defined between the plates, a discrete spatial component is connected to only one of the plates, especially when another discrete spatial component is present in the internal fluid flow path as well and is connected to the other of the plates. On the other hand, it may be so that only one layer including discrete spatial component(s) is present in the internal fluid flow path, wherein the at least one discrete spatial component is connected to both plates. In any case, the invention offers a possibility of realizing a cell having a kind of sandwich structure comprising two plates, two outer layers including heat exchange elements, and an intermediate layer including heat exchange elements.

It is not necessary to use discrete spatial components of only one design throughout the cell according to the invention, although it may be practical to do so. For example, the invention covers embodiments of the cell comprising both wire coils and wire meshes in the respective fluid flow paths, and also embodiments of the cell which are provided with wire coils of two types, namely wire coils which are wound in two opposite directions, i.e. clockwise and counterclockwise directions, in which case pairs of intertwined coils of two types may be used.

If the heat transfer effect of the discrete spatial components on the plates is less than as would be the case when conventional pins would be used, the heat transfer effect can easily be put to the required level by designing the plates with larger dimensions and/or increasing the number of cells intended for use in a heat exchanger, which does not require any change of the basic set-up of the heat exchanger.

As is the case in the art, the plates may be of a generally planar design, wherein it may be practical if the plates are not curved and have a substantially rectangular periphery. In any case, it is practical if the plates and other components of the cell are made of a metal material. In view of the fact that the cell is subjected to high temperatures during use thereof, at least at one side, which may be higher than 650° C., even up to 750° C., 800° C. or higher, it may be advantageous to use a material commonly known as Inconel, which is material from a family of austenitic nickel-chromium-based high-performance alloys. As used in the context of the invention, the content of nickel of the nickel alloys may be typically higher than 20%. Examples of heat resistant material include Aisi 310, Inconel (Alloy) 800, Inconel (Alloy) 600, Inconel (Alloy) 625. It is to be noted that it may be practical to use Inconel only at a side of the cell that is subjected to the highest temperatures and to use other materials at another side so as to save costs. In case discrete spatial components including a wire wound to a coil are used, this can easily be realized by arranging Inconel wire coils only at one side of the cell and arranging wire coils made from another material at another side.

The invention also relates to a heat exchanger comprising a stack of cells as described in the foregoing and a housing enclosing the stack of cells.

For the purpose of discharging fluid from the internal fluid flow path of the respective cells, it is practical for the heat exchanger to comprise a discharge header. According to the invention, the discharge header may be of a far more simpler design than a conventional stack of segments that need to be interconnected, comprising a connection plate provided with slotted discharge openings, the connection plate being arranged against the cells, and each of the slotted discharge openings being aligned with an outlet of an internal fluid flow path of a cell. This design of the discharge header enables an option according to which the discharge header is composed of only the connection plate and a closure component at the position of the stack of cells, the connection plate and the closure component jointly forming a pipe-like entirety. It will be understood that forming a pipe-like entirety on the basis of no more than two components being generally dimensioned in a longitudinal direction of the entirety involves a simpler manufacturing process than forming a pipe-like entirety on the basis of a stack of segments, practically more than two segments. Also, providing a connection plate and a closure component as mentioned allows for simplification of a process of welding the cells to the header, as it this allows for welding the cells to the connection plate first and subsequently closing the header by means of the closure component. If the header would be provided in the form of a pipe from the start, welding of the cells to the header should be done on the inside of the pipe, which would be far more bothersome. It is possible to use pipe parts of a suitable heat resistant material, but it is also possible for both the connection plate and the closure component to be manufactured from a thin plate that is bended to the shape as desired.

Further, for the purpose of supplying fluid to the internal fluid flow path of the respective cells, it is practical for the heat exchanger to comprise a supply header, and also for the at least one inlet to the internal fluid flow path of the respective cells to be connected to the supply header through the at least one supply conduit of the cells. According to the invention, the supply header may be of a far more simpler design than a conventional stack of segments that need to be interconnected, comprising a connection plate having supply openings, wherein the at least one supply conduit of the cells is connected to the connection plate at the position of a supply opening. In conformity with the above explanation of possibilities relating to the discharge header, it may be so that the supply header is composed of only the connection plate and a closure component at the position of the stack of cells, the connection plate and the closure component jointly forming a pipe-like entirety.

The heat exchanger may comprise a holder component for supporting the cells on the supply header. Such a holder component may be shaped like a rack or a plurality of adjacent racks, for example, in which case the rack may be designed so as to be capable of receiving and holding a portion of the respective cells. Contrariwise, in commonly known designs, the cells are interconnected, whereby a kind of monolithic block structure is obtained, which involves high internal thermal stress levels.

The invention also relates to a micro gas turbine comprising a compressor, a turbine, a combustor, and a heat exchanger of the design as described in the foregoing, the compressor being designed to take in and pressurize gas, the combustor being designed to take in pressurized gas from the compressor and to generate hot gas on the basis of fuel combustion, the turbine being designed to take in and expand hot gas generated by the combustor, and the heat exchanger being configured and arranged to pre-heat pressurized gas before being supplied to the combustor by allowing the pressurized gas to exchange heat with expanded gas obtained from the turbine. As mentioned in the foregoing, efficiency of a micro gas turbine is significantly improved when a recuperator is used. In a practical embodiment, the internal fluid flow path of the cells of the heat exchanger is in communication with the compressor for taking in pressurized gas from the compressor, and the external fluid flow path of the cells of the heat exchanger is in communication with the turbine for taking in expanded gas from the turbine. Thus, in such an embodiment, relatively high pressure is prevailing between the plates of each of the cells of the heat exchanger during operation of the micro gas turbine. Especially in case the cells of the heat exchanger comprise at least one discrete spatial component which is located in the internal fluid flow path and which is connected to both plates, the heat exchanger is very well capable of withstanding the relatively high pressure.

When the invention is put to practice, especially when at least one discrete spatial component incorporating at least a portion of the plurality of heat exchange elements applied in the cell, the cell may be manufactured on the basis of a method in which two plates and at least three discrete spatial components for defining a plurality of heat exchange elements extending from at least one surface of the plates are provided and stacked so as to obtain a stack including successively a first outer layer including at least one spatial component, a first plate, at least one intermediate layer including at least one spatial component, a second plate, and a second outer layer including at least one spatial component, and in which connections between the plates and the spatial components are made so as to obtain a stacked entirety. As explained earlier, using discrete spatial components for defining a plurality of heat exchange elements extending from at least one surface of the plates allows for having a manufacturing process that is far less complicated than a conventional process in which the heat exchange elements are connected to the plates on a one-by-one basis.

Connections between the plates and the discrete spatial components can be made by any suitable connecting technique. Assuming that the plates and the spatial components are made of a metal material, vacuum brazing is an advantageous example of such a technique, in view of the fact that when vacuum brazing is applied, making the connections basically requires no more than providing the plates with a suitable filler agent, assembling the stack of plates and spatial components, and heating the stack in an oven while exerting pressure on the stack.

As mentioned in the foregoing, the following options are applicable to the manufacturing method of the cell. In the first place, it may be so that at least one layer including at least one discrete spatial component is realized by disposing on a plate a plurality of spatial components which include a wire wound to a coil in a configuration in which the spatial components extend alongside each other in a substantially parallel arrangement. In the second place, it may be so that the stacked entirety of two plates and at least three discrete spatial components is made by providing only three spatial components which include a wire mesh besides the two plates, in which case the manufacturing process of the cell according to the invention is even more simplified. In the third place, it is practical for the plates to be connected to each other along the periphery thereof, except at positions for having at least one inlet to and at least one outlet from an internal fluid flow path as defined between the plates. In the process, welding may be used as a suitable connecting technique, although other possibilities are also covered by the invention. In any case, according to the invention, as a step in the manufacturing method of the cell, irrespective of whether or not the cell is designed with discrete spatial components as mentioned, the stacked entirety of two plates and at least three discrete spatial components is provided with at least one supply conduit having at least one flexible portion that is compressible and expandable in a direction in which the at least one supply conduit extends, wherein the at least one supply conduit is connected to the stacked entirety at the position of the at least one inlet to the internal fluid flow path.

The individual cells are suitable to be used for manufacturing a heat exchanger. Such a heat exchanger is made by arranging the cells in a stack and enclosing the stack of cells in a housing.

As mentioned in the foregoing, the following options are applicable to the process of composing a heat exchanger of a number of cells. In the first place, it may be so that a discharge header for discharging fluid from an internal fluid flow path as defined between the plates of the respective cells is made by providing a connection plate having slotted discharge openings, arranging the connection plate against the cells and aligning each of the slotted discharge openings with an outlet of an internal fluid flow path of a cell, providing a closure component, and interconnecting the connection plate and the closure component so as to form a pipe-like entirety. In the second place, it may be so that a supply header for supplying fluid to an internal fluid flow path as defined between the plates of the respective cells is made by providing a connection plate having supply openings, connecting the at least one supply conduit of the cells to the connection plate at the position of a supply opening, providing a closure component, and interconnecting the connection plate and the closure component so as to form a pipe-like entirety. In the third place, it may be practical if a holder component is provided and arranged for supporting the cells on the supply header, which holder component may particularly be shaped like a rack or a plurality of adjacent racks, in which case the rack may be designed so as to be capable of receiving and holding a portion of the respective cells.

The invention will be further elucidated on the basis of the following description of an example of a recuperator and various components thereof.

Figure 2:
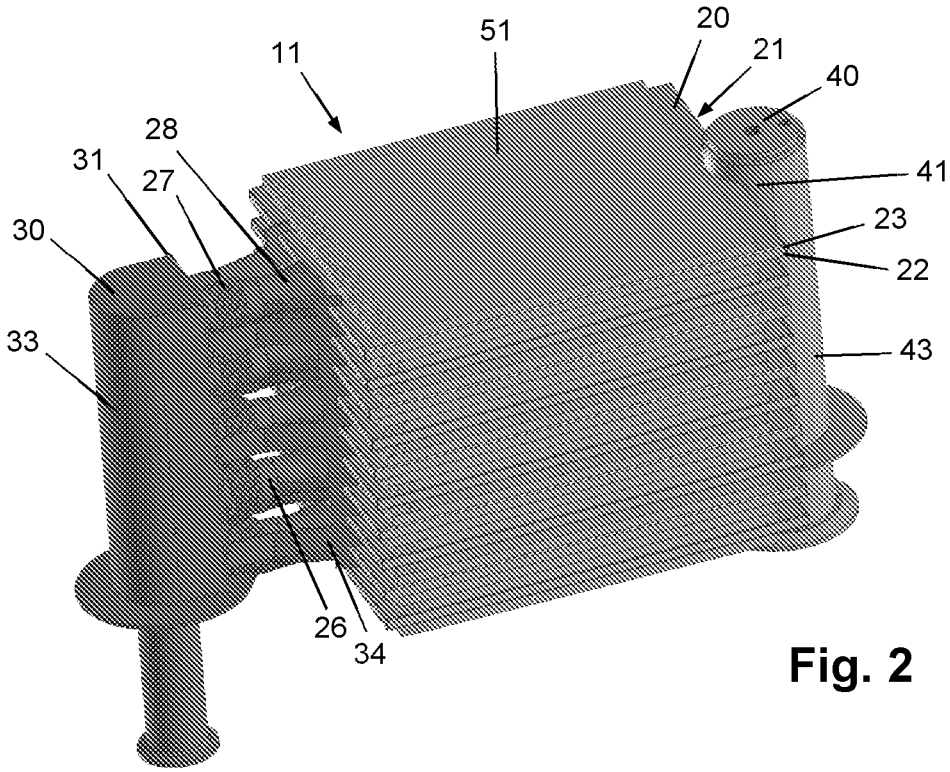
Figure 3:
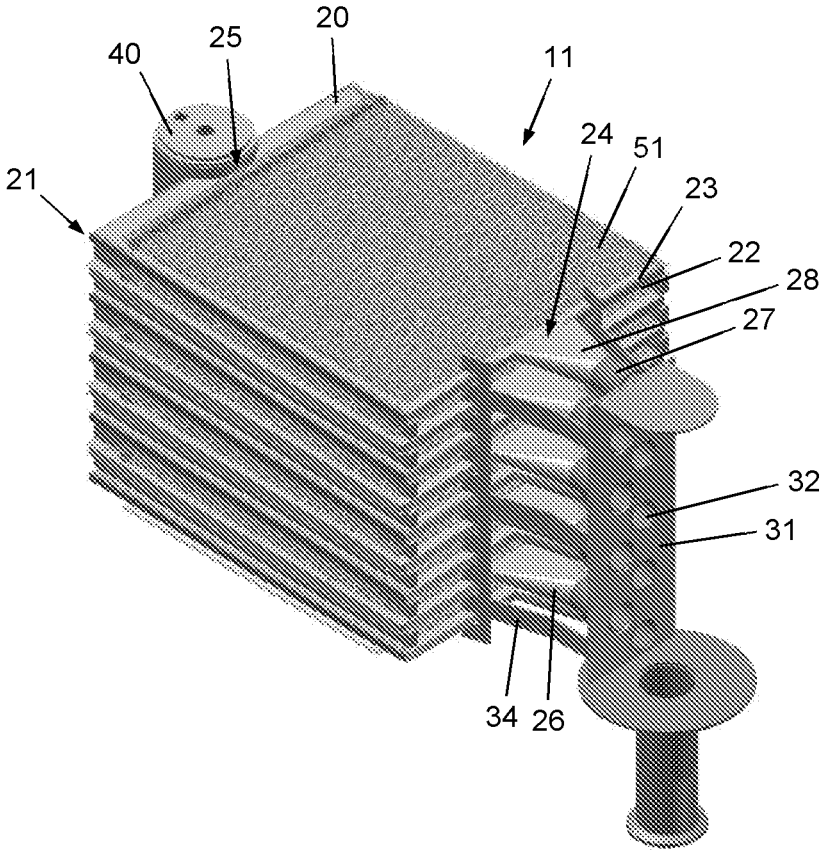
Figure 4:
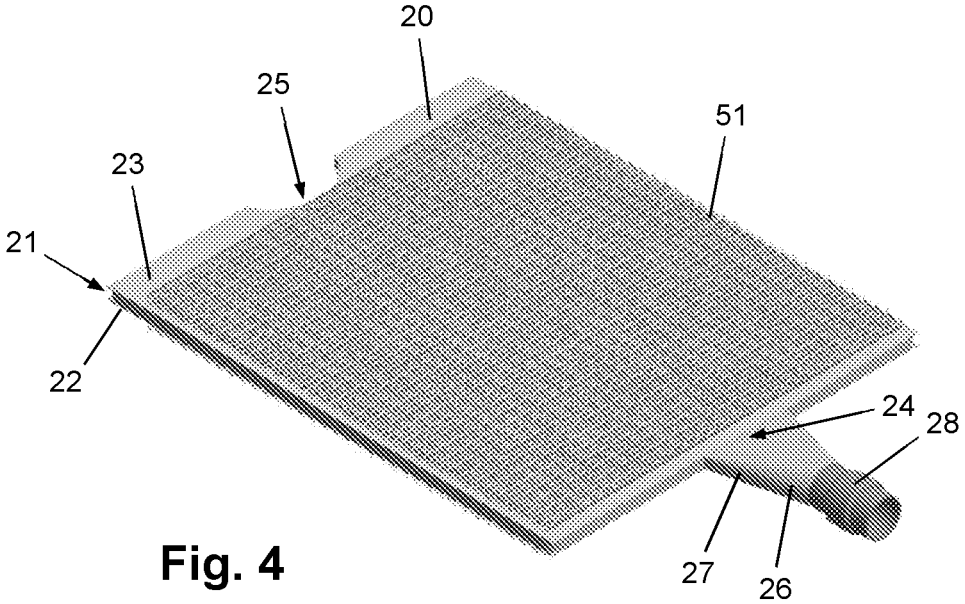
Figure 5:
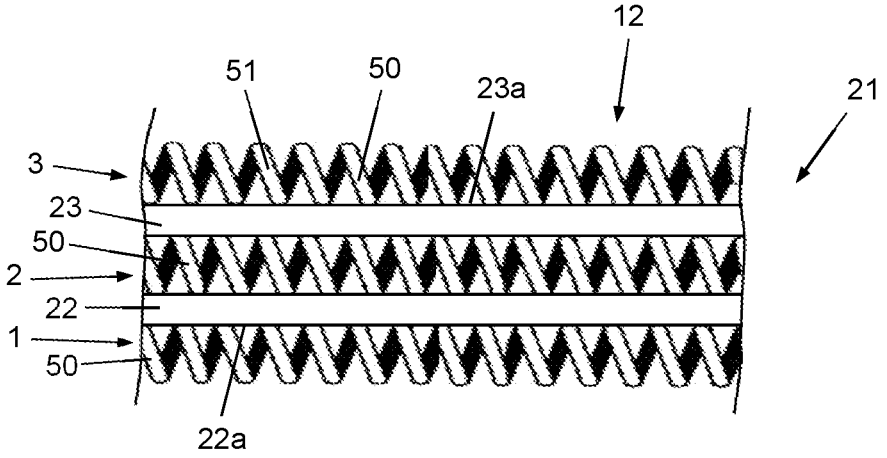
Figure 6:
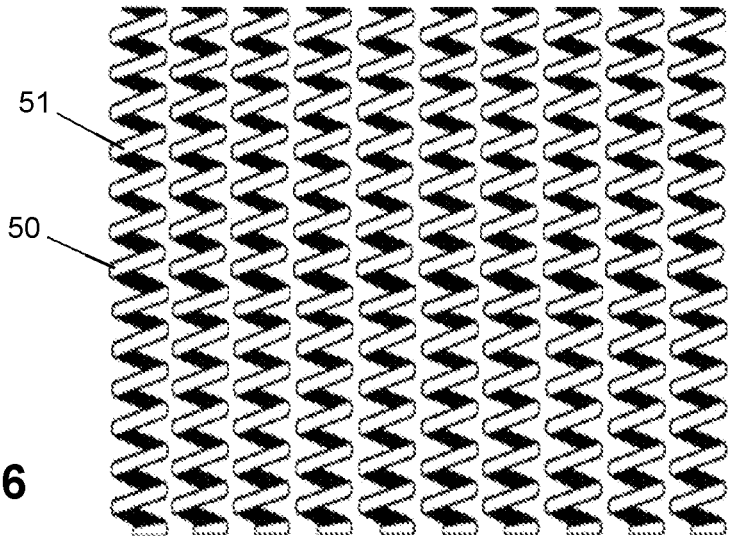
Figure 7:
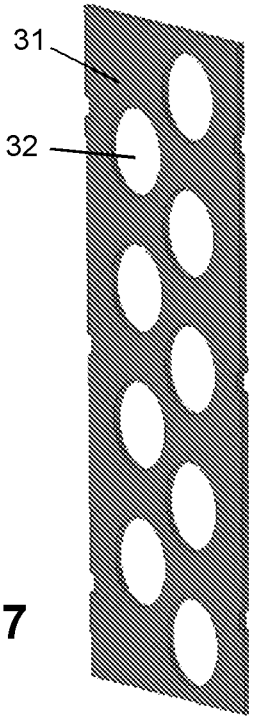
Figure 8:
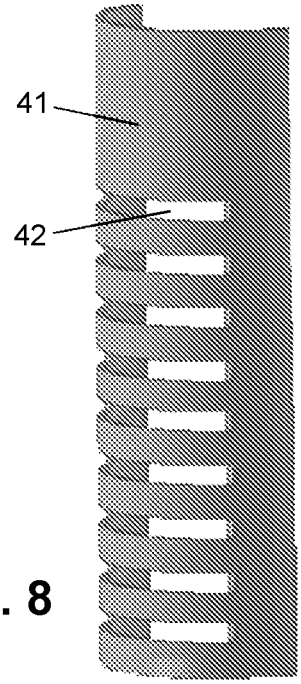
Figure 9:
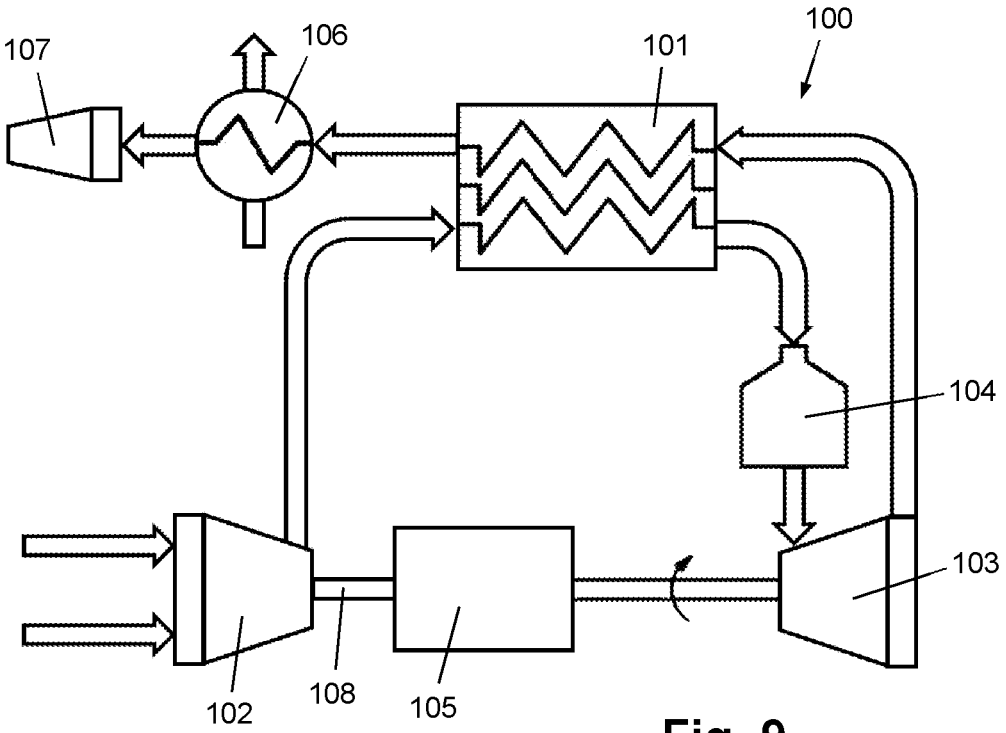

Reference will be made to the drawing, in which equal reference numerals indicate equal or similar components, and in which:

FIG. 1 diagrammatically shows a perspective view of a recuperator according to the invention;

FIG. 2 diagrammatically shows a first perspective view of a stack of cells, a supply header and a discharge header as present in the recuperator;

FIG. 3 diagrammatically shows a second perspective view of a stack of cells, a supply header and a discharge header as present in the recuperator, with a component of the supply header removed so that a connection plate of the supply header can be seen;

FIG. 4 diagrammatically shows a perspective view of a single cell from the stack of cells of the recuperator;

FIG. 5 diagrammatically shows a sectional view of a portion of a cell;

FIG. 6 diagrammatically shows a planar view of a portion of an arrangement of wire coils as present in the cell;

FIG. 7 diagrammatically shows a perspective view of a connection plate which is part of the supply header;

FIG. 8 diagrammatically shows a perspective view of a connection plate which is part of the discharge header; and FIG. 9 illustrates application of the recuperator in a micro gas turbine.

The figures relate to a recuperator 101 having features according to the invention, as will now be explained. The recuperator 101 as shown and described represents only one example of many possibilities existing within the framework of the invention.

In the shown example, the recuperator 101 is intended to be used as a gas-to-gas heat exchanger and is particularly suitable for application in the context of a micro gas turbine, which does not alter the fact that application of the recuperator 101 in other contexts is feasible as well.

FIG. 1 provides a view of the exterior of the recuperator 101, showing a housing 10 of the recuperator 101 that serves as an outer shell enclosing various components of the recuperator 101. FIG. 2 shows interior components of the recuperator 101, particularly an assembly of a stack 11 of cells 20, a supply header 30 and a discharge header 40. The stack 11 of cells 20 and the discharge header 40 are also shown in FIG. 3, wherein further the supply header 30 is partially shown as well. FIG. 4 shows a single cell 20 from the stack 11 of cells 20 of the recuperator 101.

Each of the cells 20 used in the shown recuperator 101 comprises a pair 21 of mutually spaced-apart plates 22, 23 having a substantially rectangular periphery and being generally planar, i.e. free from curves. This particular design of the plates 22, 23 is not essential within the framework of the invention, and the present disclosure of various special features of the invention is not limited to this particular design. The plates 22, 23 are connected to each other along the periphery thereof so as to delimit an internal space, except at positions where an inlet 24 to and an outlet 25 from the internal space are located. In particular, the plates 22, 23 may be provided with edges of a special design which can be welded and/or brazed together during the manufacturing process of the cell 20, without a need for using an additional frame or the like. Preferably, the connection is made along a line that is practically in the middle of the two plates 22, 23, so that it is ensured that local thermal stresses during the welding process will not cause deformation of the cell 20, particularly one of the plates 22, 23. During operation of the recuperator 101, the internal space of the cells 20 serves as an internal fluid flow path. Further, a plurality of heat exchange elements 50 is arranged in the internal fluid flow path, and also on the two outer surfaces 22*a*, 23*a* of the plates 22, 23 facing away from each other, i.e. in an external fluid flow path of the cell 20.

As can be seen in FIG. 5, the cell 20 has a layered structure, comprising successively a first outer layer 1 of heat exchange elements 50, a first plate 22, an intermediate layer 2 of heat exchange elements 50, a second plate 23, and a second outer layer 3 of heat exchange elements 50. In respect of the intermediate layer 2 of heat exchange elements 50, it is noted that this layer 2 may comprise heat exchange elements 50 which are connected to both plates 22, 23, but it is also possible for this layer to comprise heat exchange elements 50 which are connected to only one of the plates 22, 23, wherein it may be so that a number of heat exchange elements 50 is connected to the first plate 22 and that the rest of the heat exchange elements 50 is connected to the second plate 23. However, in view of having optimal mechanical strength of the cell 20, the first option is preferred, as in that case, the plates 22, 23 are not only connected to each other along the periphery thereof, but also through the plurality of heat exchange elements 50. Thus, the cell 20 can be very well made suitable for applications involving relatively high pressures.

According to an advantageous option, the heat exchange elements 50 are not provided as individual components, but are arranged on the respective plates 22, 23 as part of a discrete spatial component comprising a plurality of heat exchange elements 50. In the example as shown in the figures, each layer 1, 2, 3 of heat exchange elements 50 comprises a number of discrete spatial components 51 in the form of elongated wire coils. As illustrated in FIG. 6, the wire coils 51 of each layer 1, 2, 3 are arranged so as to extend substantially parallel to each other.

The cell 20 according to the shown example is made by providing the two plates 22, 23 and a plurality of wire coils 51, and making a stack 12 of a first number of wire coils 51 in the substantially parallel arrangement as mentioned, the first plate 22, a second number of wire coils 51 in the substantially parallel arrangement as mentioned, the second plate 23, and a third number of wire coils 51 in the substantially parallel arrangement as mentioned. The stack 12 may be prepared for vacuum brazing, i.e. provided with a suitable filler agent at appropriate places before putting the stack 12 together and exerting pressure on the stack 12 once it has been put together, and heated in an oven so that the various layers 1, 2, 3 of heat exchange elements 50 and the plates 22, 23 get interconnected. Interconnecting the plates 22, 23 along the periphery thereof is then performed after the vacuum brazing has taken place, or this is done by vacuum brazing as well. The high temperature vacuum brazing process may be carried out in any useful way, wherein it is possible to use foil, powder or paste for making the necessary interconnections. In order to avoid high costs of the brazing process, it may be practical to make use of disposable ceramic strips and metal clips for holding the ceramic strips at edge positions on the stack 12.

During operation of the recuperator 101, one fluid is made to flow through the internal fluid flow path of the cell 20, while another fluid is made to flow through the external fluid flow path of the cell 20. The heat exchange elements 50 have a function in enhancing heat exchange between the two fluids. In the first place, the heat exchange elements 50 constitute an enlargement of the surface at which heat exchange can take place. In the second place, the heat exchange elements 50 assist in spreading the fluids across the plates 22, 23. In the third place, the presence of the heat exchange elements 50 in the cell 20 contributes to the mechanical integrity of the cell 20, as the plates 22, 23 are not only interconnected along the periphery thereof, but may also be interconnected through the heat exchange elements 50. This aspect of the use of heat exchange elements 50 in the cell 20 is especially advantageous in view of the fact that this enables the cell 20 to withstand relatively high pressures at the position of the internal space thereof. The various wire coils 51 used in the cell 20 may be adjusted to specific operational circumstances, especially as far as the choice of material is concerned. Wire coils 51 which are arranged at a side of the cell 20 that may be expected to get very hot may be made of another material than wire coils 51 which are arranged at a colder side of the cell 20.

The discrete spatial components used in the cell 20 for defining the heat exchange elements 50 do not necessarily need to comprise the wire coils 51 as shown. Alternative embodiments of the spatial components are feasible within the framework of the invention. For example, wire meshes may be used in the cell 20, wherein it may be so that dimensions of the wire meshes are chosen such that a layer 1, 2, 3 of heat exchange elements 50 can be realized by means of only one wire mesh. In general, the spatial components are designed so as to provide heat exchange elements 50 in a fluid flow path for interacting with a flow of fluid, wherein it is advantageous if the heat exchange elements 50 are shaped so as to realize an as large as possible heat exchange surface at minimal pressure loss across the cell 20.

Besides the pair 21 of plates 22, 23 and the layers 1, 2, 3 of heat exchange elements 50, the cell 20 comprises a supply conduit 26 extending/projecting from the inlet 24. In the recuperator 101, the cell 20 is connected to the supply header 30 through the supply conduit 26, as can be seen in FIGS. 2 and 3. In the shown example, the supply conduit 26 comprises two distinctive portions, namely a bellows-shaped pipe portion 27 which is designed to compensate for heat expansion effects and to thereby avoid distortion effects, and a nozzle pipe portion 28 which diverges in the direction of the inlet 24. In the recuperator 101, the supply conduit 26 is connected to the supply header 30 through the bellows-shaped pipe portion 27 at the one side thereof, and to the plates 22, 23 at the position of the inlet 24 through the nozzle pipe portion 28 at the other side thereof. Both the bellows-shaped pipe portion 27 and the nozzle pipe portion 28 are of a basic, simple design so that the manufacturing process of the supply conduit 26 of the cell 20 can be fast and efficient. In a general sense, when the supply conduit 26 comprises something like at least one flexible portion 27 that is compressible and expandable in a direction in which the supply conduit 26 extends, which direction may also be referred to as a longitudinal direction of the supply conduit 26, the supply conduit 26 is suitable to compensate for heat expansion effects, wherein there is no need for complex measures involving high costs, a bulky/spacious design etc.

At the position of the stack 11 of cells 20, the supply header 30 comprises a connection plate 31 having supply openings 32, as can be seen in FIG. 3. The connection plate 31 is shown separately in FIG. 7. The supply conduit 26 of each of the cells 20 is connected to the supply header 30 at a position of one of the supply openings 32 of the connection plate 31. At the position of the stack 11 of cells 20, a pipe-like appearance of the supply header 30 is obtained by means of a curved closure component 33 which is designed to be joined to the connection plate 31 along longitudinal edges thereof. A suitable connecting technique such as welding may be used for assembling the supply header 30. For the purpose of avoiding a situation in which the cells 20 are supported on the supply header 30 only through the supply conduit 26, which would put construction requirements on the supply conduit 26, a rack-like holder component 34 is arranged so as to extend from the connection plate 31 of the supply header 30 and to engage with edge portions of the stack 12 of plates 22, 23 and layers 1, 2, 3 of heat exchange elements 50.

There is no need for compensating for heat expansion effects at both sides of the stack 11 of cells 20, and therefore, it is sufficient for the cells 20 to comprise a conduit 26 having a flexible portion 27 at only one side thereof, provided that the flexible portion 27 is designed to cover a complete possible displacement range of components. Hence, the stack 12 of plates 22, 23 and layers 1, 2, 3 of heat exchange elements 50 can be connected directly to the discharge header 40. In view thereof, the discharge header 40 comprises a connection plate 41 provided with slotted discharge openings 42. The connection plate 41 is shown separately in FIG. 8. Each of the cells 20 is received in the connection plate 41 at a position in which a discharge opening 42 is open to the outlet 25 of the cell 20. At the position of the stack 11 of cells 20, a pipe-like appearance of the discharge header 40 is obtained by means of a curved closure component 43 which is designed to be joined to the connection plate 41 along longitudinal edges thereof. A suitable connecting technique such as welding may be used for assembling the discharge header 40. In the shown example, both the connection plate 41 and the closure component 43 are designed as half pipes so that a complete pipe is obtained when the connection plate 41 and the closure component 43 are put together.

As mentioned earlier, the recuperator 101 is intended to be used as a gas-to-gas heat exchanger and is particularly suitable for application in the context of a micro gas turbine. FIG. 9 shows a scheme of various components of a micro gas turbine 100, wherein fluid flows are indicated by means of large arrows. The micro gas turbine 1 may be dimensioned to generate up to 30 kW electric power, for example. Besides the recuperator 101, the micro gas turbine 100 comprises a compressor 102, a turbine 103, a combustor 104, a high speed generator 105, a heat exchanger 106 and an exhaust 107. The high speed generator 105 is arranged on a common shaft 108 of the compressor 102 and the turbine 103. When the micro gas turbine 100 is operated, air is input to the compressor 102 and fuel is input to the combustor 104. The compressor 102 acts to compress the air and to thereby pressurize the air to about 3 bar. The compressed air is supplied to the recuperator 101 where it is pre-heated under the influence of heat exchange with exhaust gas from the turbine 103. The compressed air is supplied to the combustor 104 which is configured and arranged to output hot gas under the influence of heat generated by fuel combustion. The hot pressurized gas is expanded in the turbine 103, on the basis of which mechanical power is obtained that is used for powering both the compressor 102 and the high speed generator 105. In the process, the common shaft 108 performs a rotary movement as indicated by means of a small bent arrow.

Exhaust gas from the turbine 103 is supplied to the recuperator 101 for heating compressed air from the compressor 102, as mentioned. After having passed the recuperator 101, the gas from the turbine 103 is made to flow through the heat exchanger 106 and finally through the exhaust 107. The heat exchanger 106 serves to heat a suitable medium such as water. Thus, output of the micro gas turbine 100 is realized at the heat exchanger 106, as mentioned, and the high speed generator 105, wherein it is noted that the latter is designed to be used to convert mechanical power to electric power.

In the recuperator 101, the low pressure hot gas from the turbine 103 is made to flow through the external fluid flow path of the various cells 20, whereas the high pressure cold air from the compressor 102 is made to flow through the internal fluid flow path of the various cells 20. In this respect, it is noted that the relatively hot side of the recuperator 101 is at the discharge header 40, whereas the relatively cold side of the recuperator 101 is at the supply header 30. In view thereof, it is advantageous to have the means for compensating for heat expansion at the side of the supply header 30, as is the case in the shown example where a bellows-shaped pipe portion 27 is incorporated in a supply conduit 26 of the cells 20. The same is applicable to the nozzle pipe portion 28 of the supply conduit 26 of the cells 20.

Thus, the recuperator 101 serves to heat up the air from the compressor 102, that is to be supplied to the turbine 103 after having passed the combustor 104, and to cool down the gas from the turbine 103, wherein the air from the compressor 102 is transported to the cells 20 of the recuperator 101 through the supply header 30 and transported away from the cells 20 through the discharge header 40. In the context of the micro gas turbine 100, a temperature at the turbine side of the recuperator 101 may be as high as 750°, or even 800° C. or higher, and both the temperature differential and the pressure differential across the recuperator 101 are relatively high as well, in view of the fact that a temperatures at the compressor side of the recuperator 101 may be about 250° C., and the fact that the pressure of the air from the compressor 102 may be about 3 bar whereas the pressure of the gas from the turbine 103 is at ambient pressure. It appears in practice that the recuperator 101 of the design as shown in the figures and described in the foregoing maintains its functionality under the extreme circumstances, while realizing an efficient heat exchange process. Thus, the invention provides a recuperator 101 of a relatively uncomplicated design which is still capable of performing the heat exchange process as desired and meeting the various requirements as applicable to the process, and which has a lifetime that is at least comparable to that of a recuperator of a conventional design, such as the recuperator known from WO 2006/072789 A1. Compared to a recuperator of conventional design, a reduction of costs of more than 50% can be realized.

It will be clear to a person skilled in the art that the scope of the invention is not limited to the examples discussed in the foregoing, but that several amendments and modifications thereof are possible without deviating from the scope of the invention as defined in the attached claims.

Also, it will be clear to a person skilled in the art that various aspects of the invention are independently applicable. In this respect, it is noted that the following items are feasible:

a cell 20 for use in a heat exchanger 101, including a pair 21 of mutually spaced-apart plates 22, 23 which is configured and arranged to define an internal fluid flow path of the cell 20, particularly between two inner surfaces of the plates 22, 23 facing each other, and an external fluid flow path of the cell 20, particularly at two outer surfaces 22*a*, 23*a* of the plates 22, 23 facing away from each other, wherein the plates 22, 23 are connected to each other along the periphery thereof, except at positions where at least one inlet 24 to and at least one outlet 25 from the internal fluid flow path are located, and wherein a plurality of heat exchange elements 50 is arranged in each of the fluid flow paths, the plurality of heat exchange elements 50 of a fluid flow path being defined by at least one discrete spatial component 51 incorporating at least a portion of the plurality of heat exchange elements 50 and being at least connected to an adjacent one of the plates 22, 23;

a heat exchanger 101 comprising a stack 11 of cells 20 and a housing 10 enclosing the stack 11 of cells 20, each of the cells 20 including a pair 21 of mutually spaced-apart plates 22, 23 which is configured and arranged to define an internal fluid flow path of the cell 20, particularly between two inner surfaces of the plates 22, 23 facing each other, and an external fluid flow path of the cell 20, particularly at two outer surfaces 22*a*, 23*a* of the plates 22, 23 facing away from each other, wherein the plates 22, 23 are connected to each other along the periphery thereof, except at positions where at least one inlet 24 to and at least one outlet 25 from the internal fluid flow path are located, and wherein a plurality of heat exchange elements 50 is arranged in each of the fluid flow paths, the heat exchanger 101 comprising a discharge header 40 for discharging fluid from the internal fluid flow path of the respective cells 20, the discharge header 40 comprising a connection plate 41 provided with slotted discharge openings 42, the connection plate 41 being arranged against the cells 20, and each of the slotted discharge openings 42 being aligned with an outlet 25 of an internal fluid flow path of a cell 20;

a heat exchanger 101 comprising a stack 11 of cells 20 and a housing 10 enclosing the stack 11 of cells 20, each of the cells 20 including a pair 21 of mutually spaced-apart plates 22, 23 which is configured and arranged to define an internal fluid flow path of the cell 20, particularly between two inner surfaces of the plates 22, 23 facing each other, and an external fluid flow path of the cell 20, particularly at two outer surfaces 22*a*, 23*a* of the plates 22, 23 facing away from each other, wherein the plates 22, 23 are connected to each other along the periphery thereof, except at positions where at least one inlet 24 to and at least one outlet 25 from the internal fluid flow path are located, wherein a plurality of heat exchange elements 50 is arranged in each of the fluid flow paths, and wherein, in each of the cells 20, the plurality of heat exchange elements 50 of a fluid flow path is defined by at least one discrete spatial component 51 incorporating at least a portion of the plurality of heat exchange elements 50 and being at least connected to an adjacent one of the plates 22, 23.

a heat exchanger 101 comprising a stack 11 of cells 20 and a housing 10 enclosing the stack 11 of cells 20, each of the cells 20 including a pair 21 of mutually spaced-apart plates 22, 23 which is configured and arranged to define an internal fluid flow path of the cell 20, particularly between two inner surfaces of the plates 22, 23 facing each other, and an external fluid flow path of the cell 20, particularly at two outer surfaces 22*a*, 23*a* of the plates 22, 23 facing away from each other, wherein the plates 22, 23 are connected to each other along the periphery thereof, except at positions where at least one inlet 24 to and at least one outlet 25 from the internal fluid flow path are located, wherein a plurality of heat exchange elements 50 is arranged in each of the fluid flow paths, and wherein each of the cells 20 comprises at least one supply conduit 26 extending from the at least one inlet 24 to the internal fluid flow path, the heat exchanger 101 comprising a supply header 30 for supplying fluid to the internal fluid flow path of the respective cells 20, the at least one inlet 24 to the internal fluid flow path of the respective cells 20 being connected to the supply header 30 through the at least one supply conduit 26 of the cells 20, the supply header 30 comprising a connection plate 31 having supply openings 32, and the at least one supply conduit 26 of the cells 20 being connected to the connection plate 31 at the position of a supply opening 32;

a method of manufacturing a cell 20 for use in a heat exchanger 101, wherein two plates 22, 23 and a plurality of heat exchange elements 50 configured to extend from at least one surface 22*a*, 23*a* of the plates 22, 23 are provided and stacked so as to obtain a stack 12 including successively a first outer layer 1 including heat exchange elements 50, a first plate 22, at least one intermediate layer 2 including heat exchange elements 50, a second plate 23, and a second outer layer 3 including heat exchange elements 50, wherein connections between the plates 22, 23 and the heat exchange elements 50 are made so as to obtain a stacked entirety 12, wherein the plates 22, 23 are connected to each other along the periphery thereof, except at positions for having at least one inlet 24 to and at least one outlet 25 from an internal fluid flow path as defined between the plates 22, 23, wherein the stacked entirety 12 of two plates 22, 23 and layers 1, 2, 3 including heat exchange elements 50 is provided with at least one supply conduit 26 having at least one flexible portion 27, preferably a flexible portion 27 that is compressible and expandable in a direction in which the at least one supply conduit 26 extends, and wherein the at least one supply conduit 26 is connected to the stacked entirety 12 at the position of the at least one inlet 24 to the internal fluid flow path;

a method of manufacturing a heat exchanger 101, wherein cells 20 are manufactured by providing two plates 22, 23 and a plurality of heat exchange elements 50 configured to extend from at least one surface 22*a*, 23*a* of the plates 22, 23, stacking the plates 22, 23 and the heat exchange elements 50 so as to obtain a stack 12 including successively a first outer layer 1 including heat exchange elements 50, a first plate 22, at least one intermediate layer 2 including heat exchange elements 50, a second plate 23, and a second outer layer 3 including heat exchange elements 50, making connections between the plates 22, 23 and the heat exchange elements 50 so as to obtain a stacked entirety 12, and connecting the plates 22, 23 to each other along the periphery thereof, wherein the cells 20 are arranged in a stack 11, wherein the stack 11 of cells 20 is enclosed in a housing 10, and wherein a discharge header 40 for discharging fluid from an internal fluid flow path as defined between the plates 22, 23 of the respective cells 20 is made by providing a connection plate 41 having slotted discharge openings 42, arranging the connection plate 41 against the cells 20 and aligning each of the slotted discharge openings 42 with an outlet 25 of an internal fluid flow path of a cell 20, providing a closure component 43, and interconnecting the connection plate 41 and the closure component 43 so as to form a pipe-like entirety; and a method of manufacturing a heat exchanger 101, wherein cells 20 are manufactured by providing two plates 22, 23 and a plurality of heat exchange elements 50 configured to extend from at least one surface 22*a*, 23*a* of the plates 22, 23, stacking the plates 22, 23 and the heat exchange elements 50 so as to obtain a stack 12 including successively a first outer layer 1 including heat exchange elements 50, a first plate 22, at least one intermediate layer 2 including heat exchange elements 50, a second plate 23, and a second outer layer 3 including heat exchange elements 50, making connections between the plates 22, 23 and the heat exchange elements 50 so as to obtain a stacked entirety 12, connecting the plates 22, 23 to each other along the periphery thereof, providing the stacked entirety 12 of two plates 22, 23 and at least three discrete spatial components 51 with at least one supply conduit 26, and connecting the at least one supply conduit 26 to the stacked entirety 12 at the position of the at least one inlet 24 to the internal fluid flow path, wherein the cells 20 are arranged in a stack 11, wherein the stack 11 of cells 20 is enclosed in a housing 10, and wherein a supply header 30 for supplying fluid to an internal fluid flow path as defined between the plates 22, 23 of the respective cells 20 is made by providing a connection plate 31 having supply openings 32, connecting the at least one supply conduit 26 of the cells 20 to the connection plate 31 at the position of a supply opening 32, providing a closure component 33, and interconnecting the connection plate 31 and the closure component 33 so as to form a pipe-like entirety.

A possible summary of the invention reads follows. A heat exchanger 101 that is suitable to be used as a recuperator in a micro gas turbine 100 comprises a stack 11 of cells 20. Each of the cells 20 includes a pair 21 of mutually spaced-apart plates 22, 23 and layers 1, 2, 3 of heat exchange elements 50 arranged at the outer surfaces 22*a*, 23*a* of the plates 22, 23 and between the plates 22, 23. Each of the layers 1, 2, 3 of heat exchange elements 50 preferably comprises at least one discrete spatial component 51 incorporating a plurality of heat exchange elements 50. For example, each of the layers 1, 2, 3 of heat exchange elements 50 may comprise a number of wire coils 51 or a wire mesh. Further, both a supply header 30 and a discharge header 40 of the heat exchanger 101 are preferably composed of only two components 31, 33; 41, 43 at the position of the stack 11 of cells 20. Means for compensating for heat expansion effects are of uncomplicated design as well and may comprise a bellows-shaped pipe portion 27 of a supply conduit 26.

In a general sense, the invention provides a heat exchanger 101 that is suitable to be used as a recuperator in a micro gas turbine 100, while still being of relatively uncomplicated design. As an advantageous consequence, a method of manufacturing the heat exchanger 101 is relatively uncomplicated as well and does not involve expensive tooling. Further, the invention allows for building a high temperature recuperator from materials being lower grade materials in comparison to materials commonly applied in view of the temperatures to be expected during the recuperator's lifetime, as the invention provides a recuperator of a design with improved internal strength and heat resistance. In practice, it may even be so that stainless steel may be used at areas where normally a high grade material such as Inconel would be required. The invention provides measures on the basis of which it is possible to have structural features intended to compensate for thermal expansion effects and to create stress relief only at the relatively cold side of the heat exchanger 101, thereby providing more design freedom in respect of choice of material, and also more possibilities of using standard components and/or manufacturing components from readily available sheets, while a need for complex shapes from special heat resistant material is avoided/minimized.

The invention claimed is:

1. A heat exchanger comprising:

a stack of cells, each cell comprising:

a pair of mutually spaced-apart plates configured and arranged to define:

an internal fluid flow path of the cell; and an external fluid flow path of the cell;

heat exchange elements arranged in each of the fluid flow paths; and a supply conduit;

wherein the mutually spaced-apart plates are connected to each other along the periphery thereof, except at positions where an inlet to and an outlet from the internal fluid flow path of the cell are located; and wherein the supply conduit:

extends a length from the inlet to the internal fluid flow path of the cell;

has a substantially straight longitudinal axis along the length; and has a flexible portion that is compressible and expandable in a direction along the substantially straight longitudinal axis in which the supply conduit extends;

a housing enclosing the stack of cells; and a supply header having a substantially straight longitudinal axis extending generally perpendicular to the substantially straight longitudinal axis of the supply conduit of the respective cells, the supply header configured for supplying fluid to the internal fluid flow path of the respective cells;

wherein the inlet to the internal fluid flow path of the respective cells is connected to the supply header through the supply conduit of the respective cells.

2. The heat exchanger according to claim 1, wherein for each cell:

the supply conduit has a substantially straight longitudinal axis along the entire length of the supply conduit; and the flexible portion of the supply conduit includes a bellows-shaped pipe portion.

3. The heat exchanger according to claim 1, wherein for each cell, the supply conduit comprises a nozzle pipe portion that diverges in the direction of the inlet to the internal fluid flow path.

4. The heat exchanger according to claim 1, wherein for each cell, the heat exchange elements of at least one of the fluid flow paths is defined by at least one discrete spatial component incorporating at least a portion of the heat exchange elements and is at least connected to an adjacent one of the mutually spaced-apart plates.

5. The heat exchanger according to claim 1, wherein for each cell, the heat exchange elements of the internal fluid flow path is defined by at least one discrete spatial component incorporating at least a portion of the heat exchange elements and is connected to both mutually spaced-apart plates.

6. The heat exchanger according to claim 4, wherein at least one discrete spatial component is selected from the group consisting of a wire wound to a coil, a wire mesh, a foil, a louvre, an elongated rib, and a metal foam.

7. The heat exchanger according to claim 4, wherein the heat exchange elements of at least one of the fluid flow paths is defined by a plurality of discrete spatial components that includes a wire wound to a coil; and wherein the spatial components extend alongside each other in a substantially parallel arrangement.

8. The heat exchanger according to claim 1 further comprising a discharge header having a substantially straight longitudinal axis extending generally perpendicular to the substantially straight longitudinal axis of the supply conduit of the respective cells, the discharge header configured for discharging fluid from the internal fluid flow path of the respective cells;

wherein the discharge header comprises a connection plate provided with slotted discharge openings;

wherein the connection plate is arranged against the cells; and wherein each of the slotted discharge openings is aligned with the outlet of the internal fluid flow path of the respective cells.

9. The heat exchanger according to claim 1 further comprising a discharge header for discharging fluid from the internal fluid flow path of the respective cells;

wherein the discharge header comprises a connection plate provided with slotted discharge openings;

wherein the connection plate is arranged against the cells;

wherein each of the slotted discharge openings is aligned with the outlet of the internal fluid flow path of the respective cells;

wherein the discharge header is composed of only the connection plate and a closure component at the position of the stack of cells; and wherein the connection plate and the closure component jointly form a pipe-like entirety.

10. The heat exchanger according to claim 1, wherein the supply header comprises a connection plate having supply openings; and wherein the supply conduit of the respective cells is connected to the connection plate at the position of a respective supply opening of the supply openings.

11. The heat exchanger according to claim 10, wherein the supply header is composed of only the connection plate and a closure component at the position of the stack of cells; and wherein the connection plate and the closure component jointly form a pipe-like entirety.

12. The heat exchanger according to claim 1 further comprising a holder component for supporting the cells on the supply header.

13. The heat exchanger according to claim 12, wherein the holder component is shaped like a rack or a plurality of adjacent racks; and wherein the holder component is configured to receive and hold a portion of the respective cells.

14. A micro gas turbine comprising:

a compressor;

a turbine;

a combustor; and a heat exchanger according to claim 1;

wherein the compressor is configured to take in and pressurize gas;

wherein the combustor is configured to take in pressurized gas from the compressor and to generate hot gas on the basis of fuel combustion;

wherein the turbine is configured to take in and expand hot gas generated by the combustor; and wherein the heat exchanger is configured and arranged to pre-heat pressurized gas before being supplied to the combustor by allowing the pressurized gas to exchange heat with expanded gas obtained from the turbine.

15. The micro gas turbine according to claim 14, wherein the internal fluid flow path of each of the cells of the heat exchanger is in communication with the compressor for taking in pressurized gas from the compressor; and wherein the external fluid flow path of each of the cells of the heat exchanger is in communication with the turbine for taking in expanded gas from the turbine.

16. The heat exchanger according to claim 1, wherein for each cell:

the internal fluid flow path of the cell is configured between two inner surfaces of the mutually spaced-apart plates facing each other; and the external fluid flow path of the cell is configured at two outer surfaces of the mutually spaced-apart plates facing away from each other.

17. The heat exchanger according to claim 10, wherein the supply openings are arranged in the connection plate in two columns extending alongside each other; and wherein supply openings in one of the columns are at an intermediate position relative to supply openings in the other of the columns.

18. A heat exchanger comprising:

a stack of cells; and a housing enclosing the stack of cells;

wherein each cell comprises:

a pair of mutually spaced-apart plates;

heat exchange elements; and a supply conduit;

wherein the pair of mutually spaced-apart plates of each cell are configured and arranged to define an internal fluid flow path of the cell and an external fluid flow path of the cell;

wherein the mutually spaced-apart plates of each cell are connected to each other along the periphery thereof, except at positions where an inlet to and an outlet from the internal fluid flow path are located;

wherein the heat exchange elements of each cell are arranged in each of the fluid flow paths of the cell;

wherein the supply conduit of each cell extends a length from the inlet to the internal fluid flow path, the supply conduit having a substantially straight longitudinal axis along the length;

wherein the supply conduit of each cell has a flexible portion that is compressible and expandable in a direction along the substantially straight longitudinal axis in which the supply conduit extends; and wherein the heat exchanger further comprises one or both of:

a discharge header having a substantially straight longitudinal axis extending generally perpendicular to the longitudinal axis of the supply conduit, the discharge header configured for discharging fluid from the internal fluid flow path of the respective cells, wherein the discharge header comprises a connection plate provided with slotted discharge openings, wherein the connection plate is arranged against the cells, and wherein each of the slotted discharge openings is aligned with an outlet of an internal fluid flow path of a cell; and a supply header having a substantially straight longitudinal axis extending generally perpendicular to the longitudinal axis of the supply conduit, the supply header configured for supplying fluid to the internal fluid flow path of the respective cells, wherein the inlet to the internal fluid flow path of the respective cells is connected to the supply header through the supply conduit of the cells.

19. The heat exchanger according to claim 18, wherein one or more of:

the supply header comprises a connection plate having supply openings, wherein the supply conduit of the respective cells is connected to the connection plate at the position of a respective supply opening of the supply openings;

the supply header is composed of only a connection plate having supply openings and a closure component at the position of the stack of cells, wherein the supply conduit of the respective cells is connected to the connection plate at the position of a respective supply opening of the supply openings, and wherein the connection plate and the closure component jointly form a pipe-like entirety;

the heat exchanger further comprises a holder component for supporting the cells on the supply header;

for each cell, the internal fluid flow path of the cell is configured between two inner surfaces of the mutually spaced-apart plates facing each other, wherein the external fluid flow path of the cell is configured at two outer surfaces of the mutually spaced-apart plates facing away from each other;

for each cell, the supply conduit has a substantially straight longitudinal axis along the entire length of the supply conduit, wherein the flexible portion of the supply conduit includes a bellows-shaped pipe portion;

for each cell, the supply conduit comprises a nozzle pipe portion that diverges in the direction of the inlet to the internal fluid flow path;

for each cell, the heat exchange elements of at least one of the fluid flow paths is defined by at least one discrete spatial component incorporating at least a portion of the heat exchange elements and is at least connected to an adjacent one of the mutually spaced-apart plates;

for each cell, the heat exchange elements of the internal fluid flow path is defined by at least one discrete spatial component incorporating at least a portion of the heat exchange elements and is connected to both mutually spaced-apart plates;

the discharge header has a substantially straight longitudinal axis extending generally perpendicular to the longitudinal axis of the supply conduit of the respective cells; and the discharge header is composed of only the connection plate and a closure component at the position of the stack of cells, wherein the connection plate and the closure component jointly form a pipe-like entirety.

20. The heat exchanger according to claim 19, wherein one or more of:

the supply openings are arranged in the connection plate in two columns extending alongside each other, wherein supply openings in the one column are at an intermediate position relative to supply openings in the other column;

the holder component is shaped like a rack or a plurality of adjacent racks, wherein the holder component is configured to receive and hold a portion of the respective cells;

the at least one discrete spatial component is selected from the group consisting of a wire wound to a coil, a wire mesh, a foil, a louvre, an elongated rib, and a metal foam; and the heat exchange elements of at least one of the fluid flow paths is defined by a plurality of discrete spatial components that includes a wire wound to a coil, wherein the spatial components extend alongside each other in a substantially parallel arrangement.

* * * * *